US011946708B2

(12) United States Patent
Bireaud et al.

(10) Patent No.: US 11,946,708 B2
(45) Date of Patent: Apr. 2, 2024

(54) FRAME CONFIGURED TO SUPPORT A HEAT EXCHANGER

(71) Applicant: Valeo Systemes Thermiques, Le Mesnil Saint Denis (FR)

(72) Inventors: Fabien Bireaud, Le Mesnil Saint-Denis (FR); Rémi Tournois, Le Mesnil Saint-Denis (FR); Emmanuel Henon, Le Mesnil Saint-Denis (FR); Stephan Andre, Le Mesnil Saint-Denis (FR)

(73) Assignee: Valeo Systemes Thermiques, Le Mesnil Saint-Denis (FR)

( * ) Notice: Subject to any disclaimer, the term of this patent is extended or adjusted under 35 U.S.C. 154(b) by 175 days.

(21) Appl. No.: 17/414,846

(22) PCT Filed: Dec. 2, 2019

(86) PCT No.: PCT/FR2019/052884

§ 371 (c)(1),
(2) Date: Jun. 16, 2021

(87) PCT Pub. No.: WO2020/128194

PCT Pub. Date: Jun. 25, 2020

(65) Prior Publication Data

US 2022/0018615 A1 Jan. 20, 2022

(30) Foreign Application Priority Data

Dec. 19, 2018 (FR) ..... 1873291

(51) Int. Cl.
*F28F 9/00* (2006.01)
*F28D 21/00* (2006.01)

(52) U.S. Cl.
CPC ..... *F28F 9/002* (2013.01); *F28D 21/00* (2013.01); *F28D 2021/008* (2013.01); *F28F 2230/00* (2013.01); *F28F 2275/08* (2013.01)

(58) Field of Classification Search
CPC .... F28F 9/002; F28F 2275/08; F28F 2230/00; F28D 21/00
See application file for complete search history.

(56) References Cited

U.S. PATENT DOCUMENTS

2015/0323266 A1 11/2015 Bardeleben et al.

FOREIGN PATENT DOCUMENTS

DE 102014201991 A1 * 8/2014 ..... B60H 1/00528
DE 102014201991 A1 8/2014
(Continued)

OTHER PUBLICATIONS

International Search Report and Written Opinion issued in corresponding International Patent Application No. PCT/FR2019/052884, dated Apr. 22, 2020 (10 pages).
(Continued)

*Primary Examiner* — Devon Russell
(74) *Attorney, Agent, or Firm* — Osha Bergman Watanabe & Burton LLP

(57) ABSTRACT

Support frame (4) configured to bear a heat exchanger comprising a flange (22) for coolant to pass through, the frame comprising a lateral wall (12) in which a light (28) is produced, which is configured to be passed through by the flange (22), characterized in that the lateral wall (12) comprises at least one edge (34, 36) placed near an end of the light (28) and arranged at least partially through the light (28) so as to define an insertion path for the flange which is inclined relative to the normal to the lateral wall, the edge also being configured to form a point on which the flange pivots.

9 Claims, 10 Drawing Sheets

(56) References Cited

FOREIGN PATENT DOCUMENTS

| | | | | |
|---|---|---|---|---|
| EP | 2450658 | A1 * | 5/2012 | ..... F28F 21/067 |
| EP | 2975354 | A1 | 1/2016 | |
| FR | 2771341 | A1 | 5/1999 | |
| FR | 2961132 | A1 | 12/2011 | |
| JP | 2006-273050 | A | 10/2006 | |
| JP | 4508499 | B2 * | 7/2010 | ..... B60H 1/00464 |
| WO | 2014/124847 | A1 | 8/2014 | |
| WO | WO-2014124847 | A1 * | 8/2014 | ..... B60H 1/00528 |
| WO | 2017046532 | A1 | 3/2017 | |

OTHER PUBLICATIONS

Office Action issued in Corresponding JP application No. 2021-535673, dated Apr. 11, 2023. (5 pages with English translation).

* cited by examiner

[Figure 1]
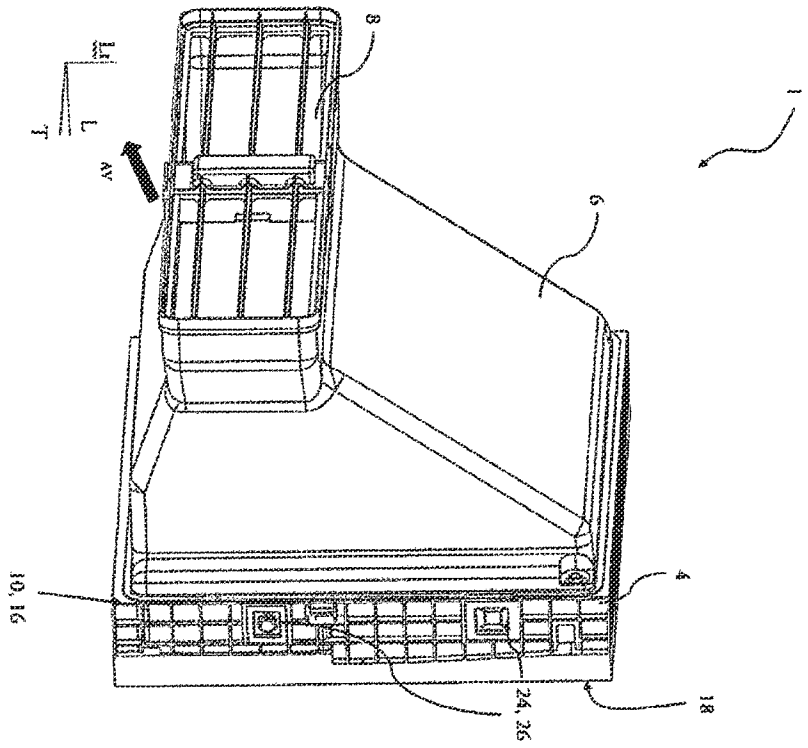

[Figure 2]
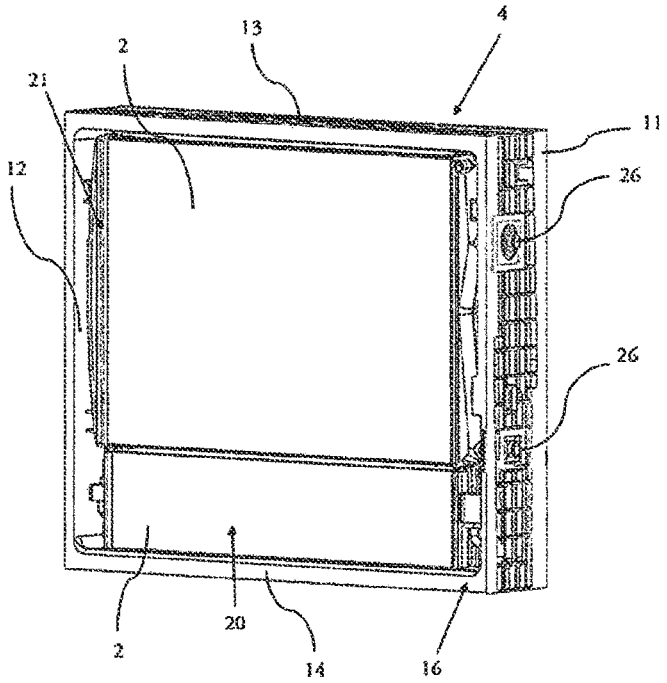

[Figure 3]
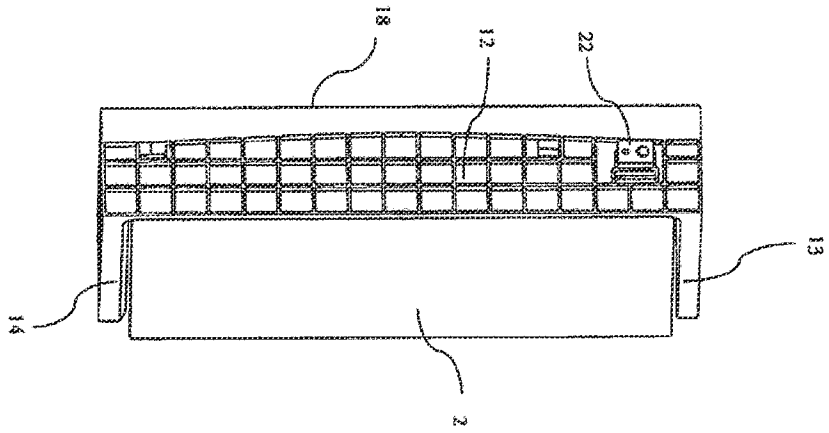

[Figure 4]
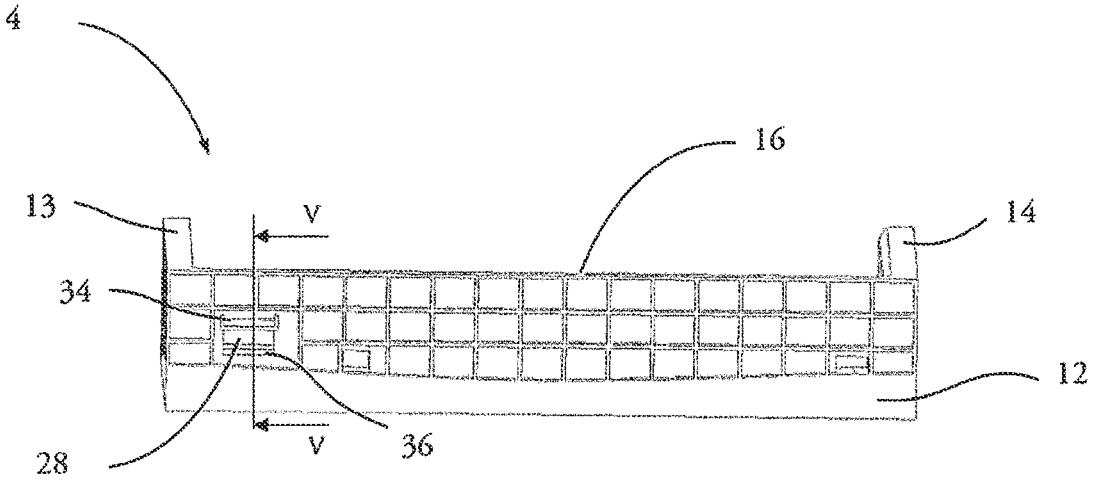

[Figure 5]
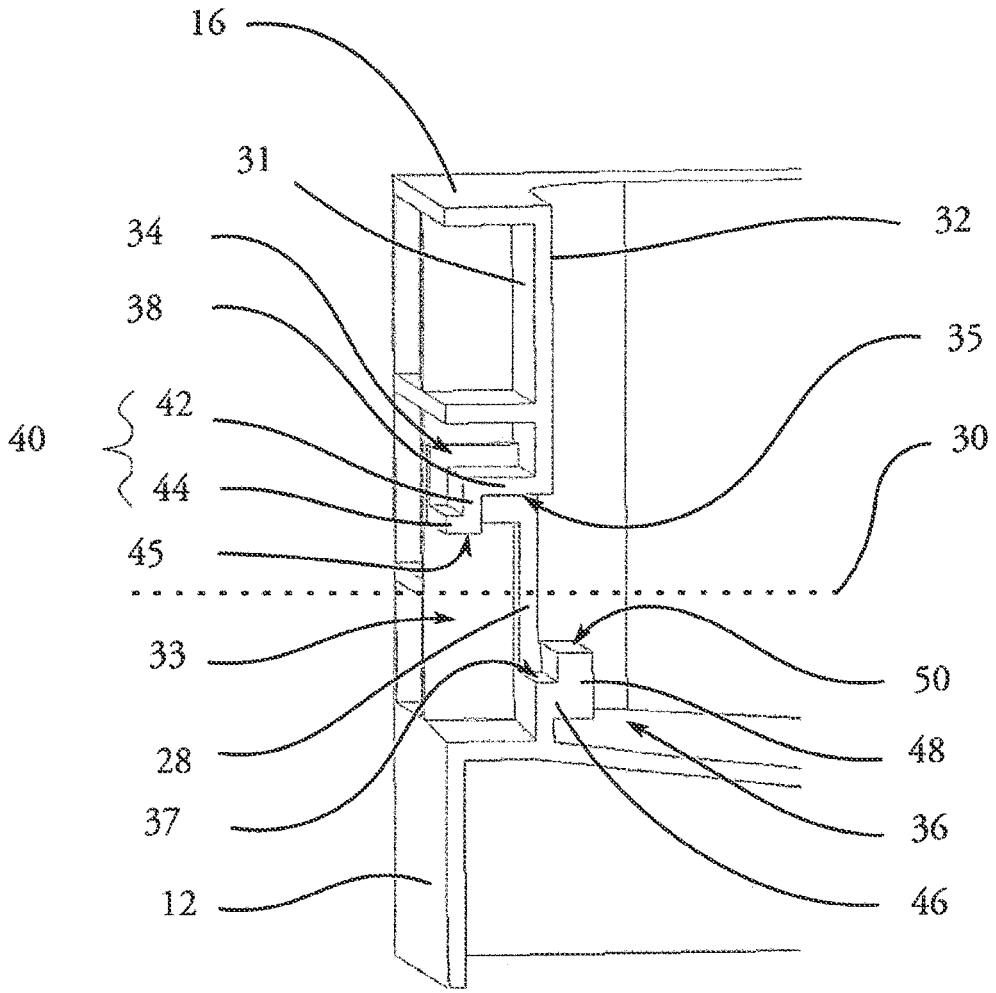

[Figure 6]
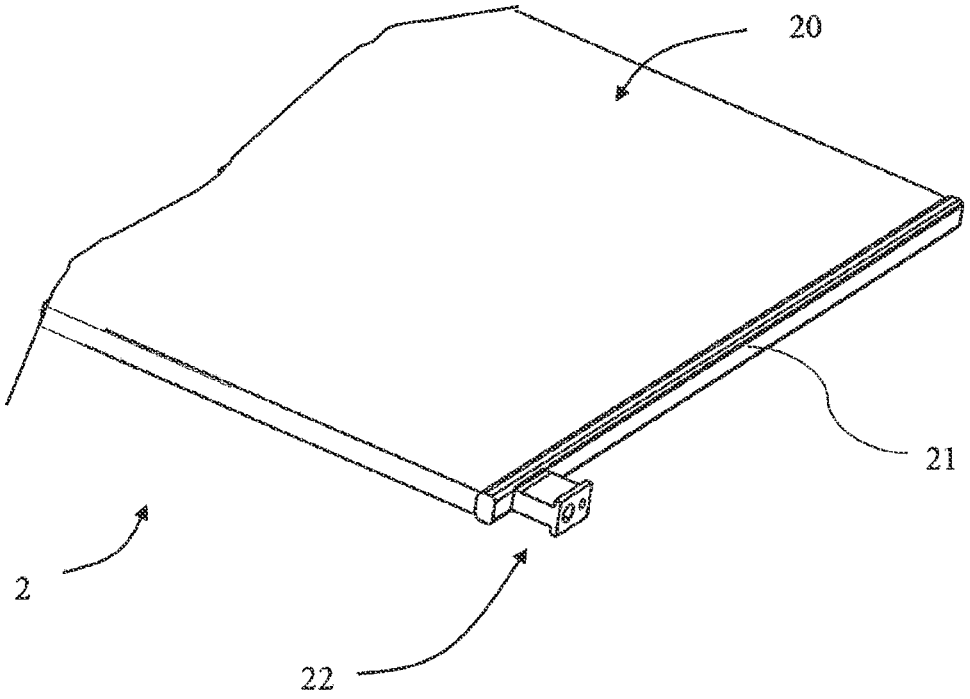

[Figure.7]
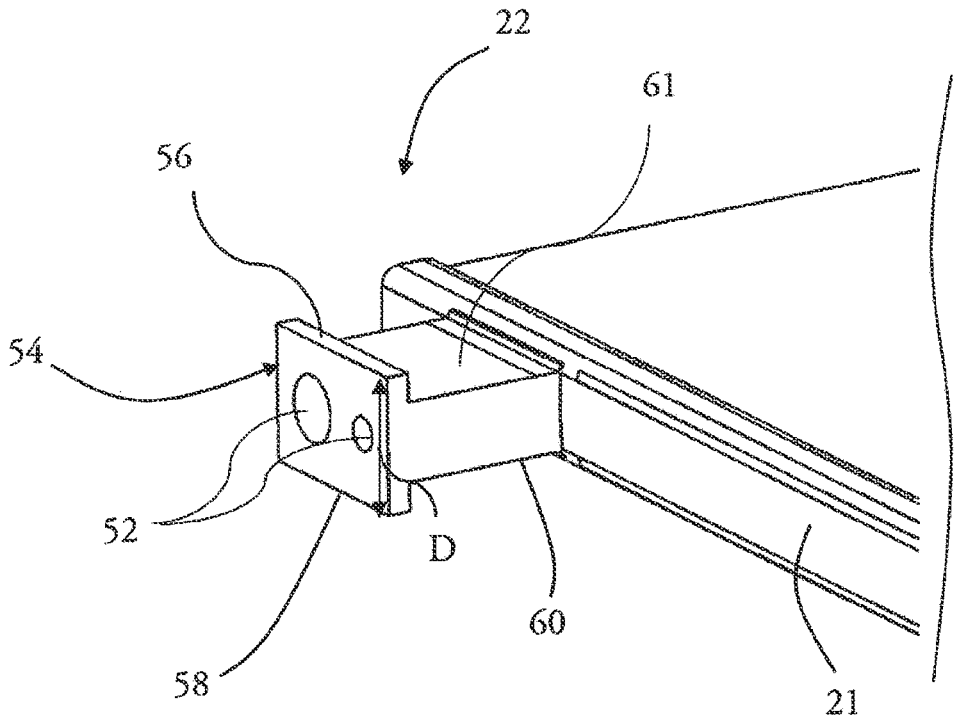

[Figure.8]
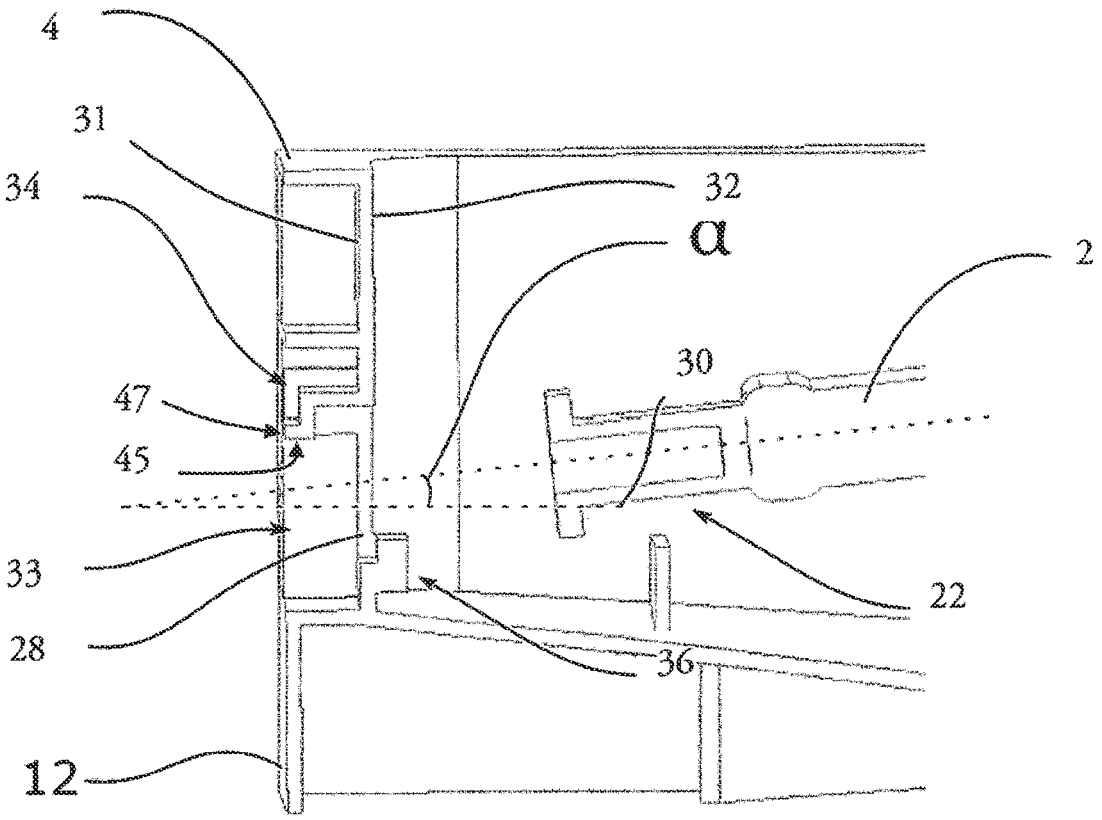

[Figure 9]
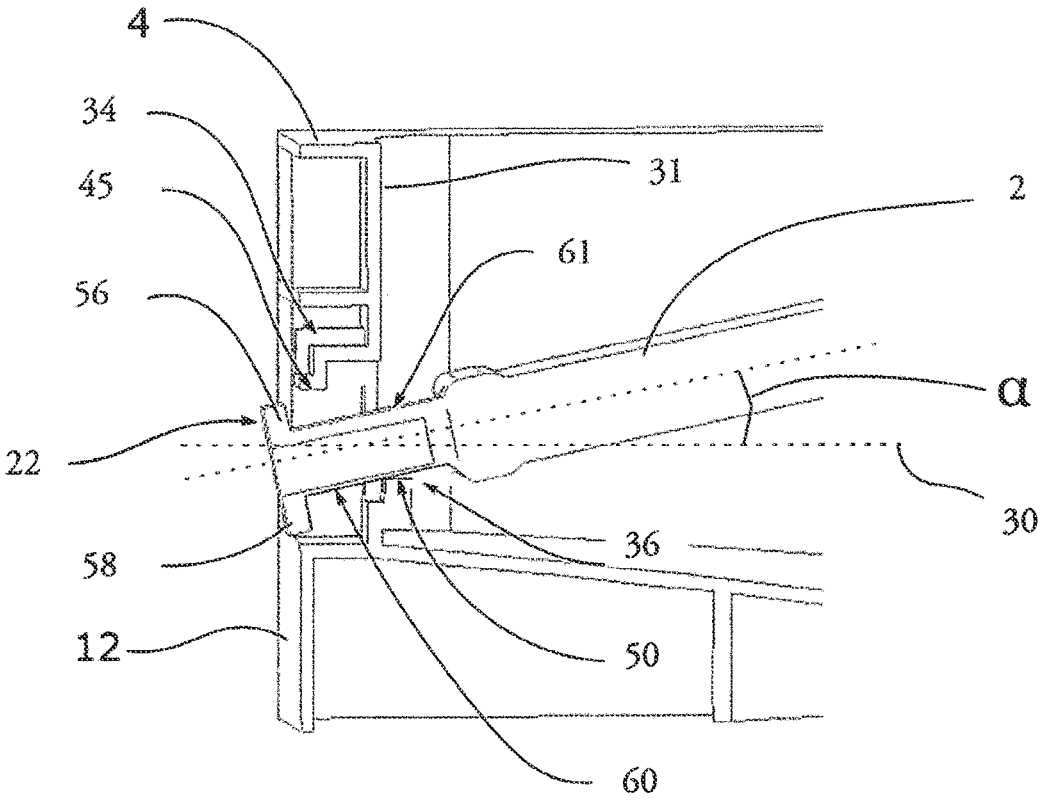

[Figure 10]
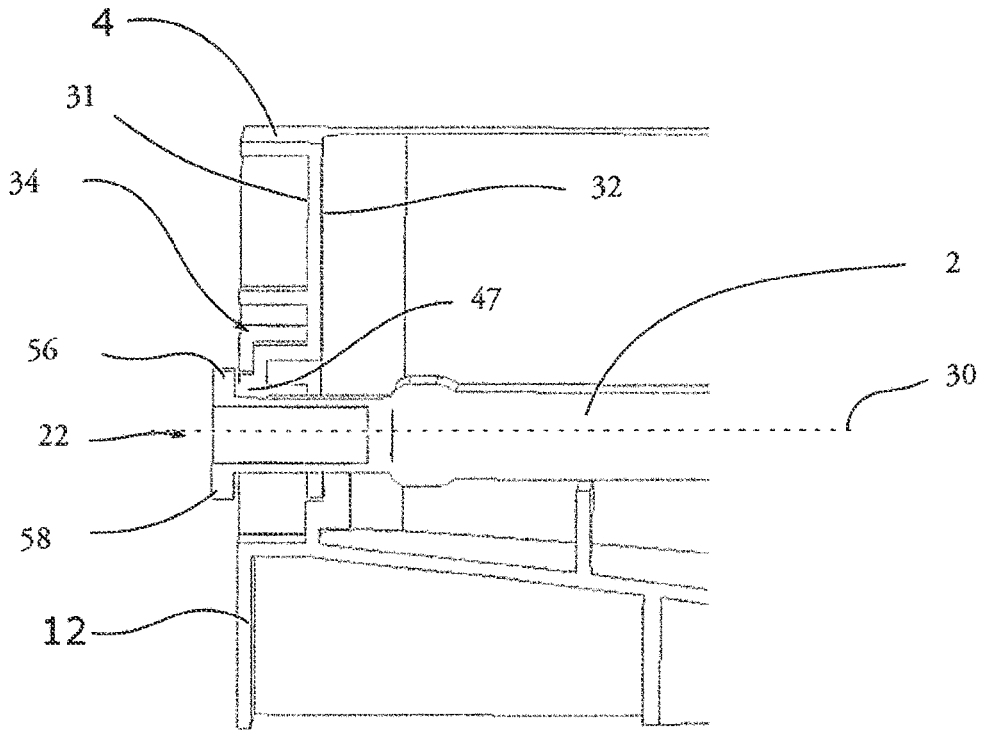

FRAME CONFIGURED TO SUPPORT A HEAT EXCHANGER

The present application concerns a front end module for a motor vehicle, in particular for a hybrid or electric vehicle, and more particularly it concerns systems comprising a frame configured to bear one or more heat exchangers contained in these systems.

It is known practice to provide motor vehicles with various circuits for coolant or heat transfer fluid, for the cooling of various components of the vehicle and in particular the engine or the batteries, and/or to form a cooling circuit for a heating, air conditioning and/or ventilation system. These various fluid circuits have to pass through one or more heat exchangers fitted to the vehicle, in particular on the front end of the vehicle, so that the fluid circulating in the exchanger can exchange heat with a stream of air entering through the front end of the vehicle.

Such systems are used both for combustion engine vehicles and for electric or hybrid vehicles. In electric or hybrid vehicles, the current electric motorization means use increasingly powerful batteries to improve the engine performance and comfort of the vehicle, while increasing the range of the vehicle. The increase in battery power must go hand in hand with research into rapid charging means. Rapid charging stations that use electrical powers greater than 50 kW are known. With such high powers, however, there is heat dissipation in the vehicle battery, which, if not discharged, can cause irreversible damage such as a reduction in battery lifespan or a limitation of its charging speed.

In order to prevent such damage, it is necessary to thermoregulate the battery, and in particular to cool the battery. For this purpose, motor vehicles are conventionally equipped with heat exchange systems capable of transferring calories from one fluid to another. A ventilation duct is used to guide the incoming air, which is cold, to one or more heat exchangers which may be arranged in a hermetically sealed encapsulation casing also encapsulating a ventilation assembly.

In the particular situation of rapid charging, the vehicle is stationary. In order to ensure sufficient air flow to allow optimal cooling of the battery, the motor-fan unit operates at high speeds, thereby generating a high overpressure within the casing. Such an overpressure is liable to cause leakage of fresh air, i.e. air exiting the casing without passing through the exchanger(s), and, where appropriate, recirculation of hot air coming from outside the casing, which has the effect of reducing the thermal performance. It is thus essential that the encapsulation casing be sealed, in particular where components such as heat exchanger inlet and outlet pipes pass through the casing, as these components constitute areas of weakness which may be the source of air leakage.

Sealing devices may be used in the encapsulation casing, in the areas where the pipes pass through the casing. It should be noted that this problem is not confined to electric and hybrid vehicles, as heat transfer fluid circuits as described above may also form part of the ventilation, heating or air conditioning systems of combustion engine vehicles. However, the known devices have many disadvantages. Due to the variety of diameters and types of pipes making up heat exchange systems, these sealing devices are often difficult to adapt and must be made to specific dimensions in order to ensure optimum sealing for the pipes of varying gauge for which they are intended.

Another drawback in the known sealing devices, in the form of attachments made of elastomer in particular, is the complexity of assembly and disassembly. Many of these devices are permanently attached, especially when they require overmolding operations to ensure sealed attachment of the pipes where they pass through the encapsulation casing. Such an operation not only makes assembly complex, but also makes any subsequent disassembly, for maintenance or repair, more difficult. Thus the installation of effective sealing elements close to passage openings formed in the casing for the pipes of these exchangers can complicate the assembly of the heat exchange systems.

The invention falls into this context and aims to remedy this drawback by proposing a front end module comprising effective sealing means for hermetic encapsulation of heat exchangers in the casing associated with the system, which module is simple to assemble.

The invention proposes a support frame configured to bear a heat exchanger comprising a flange for passage of coolant fluid, the frame comprising a side wall in which a slot is produced for the flange to pass through, characterized in that the side wall comprises at least one rim placed near an end of the slot and arranged at least partially through the slot so as to define an insertion path for the flange which is inclined relative to the normal to the side wall, said rim also being configured to form a pivot point for the flange.

According to various features of the invention, taken alone or in combination, it may be provided that:

a. the side wall comprises two rims arranged at least partially through the slot, each rim extending from edges delimiting the opposing ends of the slot;
b. the rims each have a proximal end linked to the side wall and a free distal end, the free distal end of each rim being configured to bear on a surface of the flange when the latter is placed in the support frame;
c. the rims each have a bent form extending in a longitudinal projection from the side wall in opposite directions along the normal to said side wall;
d. the free distal end of the rim extending in a longitudinal projection from the side wall towards the interior of the frame is configured to serve as a support face for the flange in order to form said pivot point in the slot;
e. the rims are configured in the bent portion such that their distal end is closer to the centre of the slot than their proximal end;
f. the minimal dimension between two crests of the distal ends of the two rims is greater than the dimension between these two crests in a projection plane congruent with the plane of extension of the side wall.

The invention also concerns a front end module comprising a support frame as claimed in any of the preceding claims, and at least one heat exchanger bearing a flange for inlet or outlet of coolant fluid, said flange bearing against at least one support face formed by a rim of said support frame.

At its free end, the flange may comprise at least one edging able to come to rest against a rim of the support frame.

The invention also concerns a method for assembling a heat exchanger with a flange for inlet/outlet of coolant fluid in a support frame as defined above.

The method implements a step of insertion of the flange in the slot made in a side wall of the support frame, with an insertion position in a plane which has an angle of inclination between 10° and 80° relative to the plane in which the heat exchanger is positioned at the end of assembly, the insertion step aiming to bring the flange through the slot at an angle while avoiding the rim or rims.

The method also implements a step of pivoting the flange in the slot in order to give the heat exchanger its final assembly position which is substantially perpendicular to the side wall.

In other words, the method comprises at least two successive steps, the first corresponding to a translational movement while the second corresponds to a rotational movement.

Other features, details and advantages of the invention and its function will become more clearly apparent from reading the description given hereinafter by way of illustration and with reference to the appended figures, in which:

FIG. 1 is a schematic perspective view of a front end module according to an aspect of the invention, in closed configuration with a ventilation duct to be attached to a support frame which houses at least one heat exchanger (not shown here), FIG. 1 showing in particular a first side of the frame and sealing devices able to allow the passage of pipes of one of the heat exchangers;

FIG. 2 is a schematic perspective view of the front end module shown in FIG. 1, in the open configuration, with the ventilation duct removed to free up the interior of the support frame and make the heat exchanger(s) housed therein accessible;

FIG. 3 is a partial perspective view of the support frame illustrated on FIG. 2 and of a heat exchanger during assembly in the support frame, the perspective angle here revealing a second side of the frame opposite the first side visible on FIG. 2, the second side comprising a sealing arrangement at the level of a fluid inlet flange of a heat exchanger in accordance with the present invention;

FIG. 4 is a side view of the frame from FIG. 3 without heat exchanger, showing an opening made in the second side of the frame and able to accommodate the inlet flange shown in FIG. 3;

FIG. 5 is a partial, sectional view of the second side of the frame at the level of the opening along sectional plane V-V shown on FIG. 4;

FIG. 6 and FIG. 7 are partial views, from different perspective angles, of the heat exchanger shown in FIG. 3, wherein FIG. 6 shows more clearly the fluid passage flange configured to cooperate with the opening formed in the second side of the frame shown on FIG. 4;

FIG. 8 illustrates a first step in a method of insertion of a flange of a heat exchanger shown in FIGS. 5 and 6 in a slot of the frame illustrated on FIGS. 3 and 4;

FIG. 9 illustrates a second step in a method of insertion of a flange of a heat exchanger shown in FIGS. 5 and 6 in a slot of the frame illustrated on FIGS. 3 and 4;

FIG. 10 illustrates a third step in a method of insertion of a flange of a heat exchanger shown in FIGS. 5 and 6 in a slot of the frame illustrated on FIGS. 3 and 4.

It should first of all be noted that although the figures set out the invention in detail for its implementation, they may, of course, be used to better define the invention if necessary. It will also be understood that the embodiment of the invention illustrated in the figures is given as a non-limitative example.

A front end module 1 according to the present invention comprises at least one heat exchanger 2, housed in an encapsulation casing formed by a support frame 4 for the heat exchanger, and at least one ventilation duct 6, configured to cooperate with said frame and guide fresh air in the direction of this frame so as to force it through the heat exchanger.

The support frame 4, also referred to as a holder frame, corresponds to a rigid structure, more specifically to a rigid plastic frame with four members delimiting a surface within which the heat exchanger 2 and possibly a motor-fan unit are arranged. In order to ensure the continuity, the ventilation duct 6, corresponding to an air flow duct, is attached to the support frame 4 in a sealed fashion. In other words, the holder frame ensures the continuity of the ventilation duct 6 or, in other words, the holder frame corresponds to part of the flow duct 6.

As specified above, the invention concerns a front end module and an associated support frame for supporting one or more heat exchangers, wherein a side wall of the frame has a slot configured to allow passage of a flange of an exchanger, the slot being associated with rims limiting the passage cross-section of said slot such that they require an inclined insertion of the heat exchanger in order for the flange to be able to follow an insertion path between the rims, wherein these rims also form a support for pivoting of the heat exchanger towards its functional position and chicanes for reducing the inlet or outlet of air through the slot formed in the support frame.

Below, and as shown in FIG. 1 for example, a longitudinal axis L will be defined as an axis parallel to the main direction of circulation of the air stream through the support frame and each heat exchanger, and the lateral Lt and transverse T orientations will be defined as orientations perpendicular to the longitudinal axis.

Such a system 1 is shown in particular, schematically, in FIG. 1 and FIG. 2 in closed and open configuration respectively. The heat exchanger(s) 2 are housed in the support frame 4, which is configured to allow the attachment of the ventilation duct 6.

When assembled one on the other so as to adopt a so-called "closed" configuration, the support frame 4 and the ventilation duct 6 form the encapsulation casing which hermetically contains the heat exchanger(s).

More particularly, the ventilation duct 6 has an air vent 8 open on the front end of the motor vehicle, thus allowing the entry of a fresh air stream which it redirects in the encapsulation casing, towards the heat exchanger(s) 2. At an end opposite the air vent, this ventilation duct has a rear end face 10 which, in the closed configuration shown in FIG. 1, is brought into contact with the support frame 4.

In a manner not shown, the support frame may form a support, on the side opposite that receiving the ventilation duct, for a ventilation assembly comprising a reinforcement integrally formed on the frame and a motorised fan arranged through the reinforcement to facilitate circulation of air through the front end module.

The support frame 4 comprises two side walls 11, 12 and two transverse walls 13, 14, which define an open volume for accommodating one or more heat exchangers 4 between the walls. A front end face 16 of the support frame is defined as being the face intended to be in contact with the ventilation duct 6, and more particularly with the rear end face 10 of this ventilation duct, and a rear end face 18 is defined as the face intended to be in contact with the ventilation assembly. It is understood that it is via this front end face 16, which faces the front of the vehicle as illustrated by the arrow AV on FIG. 1, that in the example illustrated the fresh air is brought to enter the frame in order to pass through the exchangers.

FIG. 2 shows the structure of the heat exchangers able to be housed in the support frame 4. Each heat exchanger 2 comprises an exchange surface 20 and at least one collector box 21 arranged laterally relative to said exchange surface, and at least one flange 22 for passage of coolant fluid for the inlet or outlet of fluid into or from the exchange surface, the coolant fluid being brought to exchange calories with the air passing over the exchange surface.

Each flange 22 extends from the collector box of the exchanger, substantially in the main plane of extension of the exchanger, that is to say perpendicular to the side walls 11, 12 helping define said frame 4. As a result, the flanges, allowing the connection of the exchanger to a coolant circuit not shown here, are arranged so as to pass through the support frame 4 in the passage areas 24 defined when the exchanger is assembled on the frame.

In order to ensure the tightness of the encapsulation of the front end module and thus avoid any leakage of fresh air, i.e. passage of air outside the casing without passing through the exchangers, or recirculation of hot air which would reduce the performance of the heat exchanger, the front end module 1 is equipped with a sealing element 26 at the level of the passage areas 24 on a first side wall 11 of the frame. This sealing device may take any form without leaving the context of the invention.

The invention is illustrated more particularly in FIGS. 3 and 4, in which the support frame 4 is turned so as to show the second side wall 12.

The second side wall 12 is here ribbed so as to form square alveoli. In one of these alveoli, the second side wall 12 of the support frame 4, close to a vertical end i.e. in a zone of the junction to a transverse wall 13, has a slot 28 forming a passage through the second side wall 12. The slot 28 is arranged around a main axis 30 with a direction normal or substantially normal to the side wall 12.

The slot 28 is designed to receive a flange 22 of a heat exchanger, and firstly to allow fixing of the flange and hence the exchanger relative to the support frame, and secondly to offer a sufficiently sealed structure once the heat exchanger is assembled. According to the invention, this double function is achieved solely via a suitable arrangement of ribs which, in the passage area of the slot 28, form chicanes and support surfaces for the flange and the heat exchanger. Thus it is not necessary to provide additional sealing means to be interposed between the support frame and the heat exchanger.

FIG. 3 illustrates the cooperation of the flange 22 of the heat exchanger with the side wall of the frame and the slot 28, in a first step of assembling the heat exchanger, the insertion direction of the heat exchanger and flange 22 in the slot having an angle with respect to the main axis 30 of the slot 28.

As shown on FIG. 4, the slot 28 delimits a passage of parallelepipedic form, opening on one side at an outer face 31 of the side wall 12 and on the other side at an inner opposite face 32 of said side wall.

On the side of the outer face 31 of the side wall, a clearance zone 33 is formed to allow positioning of the flange head shown on FIG. 3.

As shown on FIG. 4 for example, the slot 28 is bordered by two rims which reduce the passage cross-section. A first rim 34 is arranged at a first longitudinal end 35 of the slot 28 on the side of the outer front face 16 of the support frame 4. A second rim 36 is arranged longitudinally opposite at a second longitudinal end 37 on the side of the outer rear face 18 of the support frame 4.

The specific form of these two rims 34, 36 will now be described in more detail with reference to FIG. 5.

The first rim 34 in cross-section has the shape of a first tab of bent form which extends protruding from the outer face 31 of the side wall 12. In particular, the first rim 34 comprises a first portion 38 which protrudes substantially perpendicularly to extend the edge of the outer face delimiting the slot 28 at the level of the first longitudinal end of the slot as described above. This first portion 38 extends in a direction parallel or substantially parallel to the main axis 30 of the slot 28. The first rim 34 also comprises a first return edge 40 which extends the first portion opposite the side wall 12. This first return edge 40 in particular comprises a first return portion 42 which directly extends the first portion in the direction of the main axis 30 of the slot 28, reducing the passage cross-section of the slot 28, and a second return portion 44 which forms the free end of the first rim and extends parallel to the first portion 38 so as to form a staircase profile intended to reduce the passage cross-section of the slot 28. The second return portion 44 has a first support face 45 and a second support face 47 for supporting a respective edge of a flange once the associated heat exchanger is assembled in the support frame. The first support face 45 is turned towards the axis 30 of the slot, and the second support face 47 is turned against the side wall 12 of the support frame 4.

The second rim 36 in cross-section has the shape of a second tab of bent form which extends protruding from the inner face 32 of the side wall 12. In particular, the second rim 36 comprises a first portion 46 extending by substantially perpendicular projection the edge of the inner face delimiting the slot 28 at the level of the first longitudinal end of the slot as described above. This first portion 46 extends in a direction parallel or substantially parallel to the main axis 30 of the slot 28. The second rim 36 also comprises a second return edge 48 which directly extends the first portion in the direction of the main axis 30 of the slot, reducing the passage cross-section of the slot 28. At its free end, the second return edge 48 has a support face 50 for an edge of a flange, once the associated heat exchanger is assembled in the support frame.

It is understood from the above that the distal ends of the rims 34, 36, i.e. the free ends remote from the side wall, are partially superposed at the cross-section of the slot 28 so as to form chicanes, preventing insertion in the slot 28, in a translational movement parallel to the main axis 30 of the slot, of an object of form and dimensions similar to the passage cross-section.

The distal ends of the rims 34, 36 may be spaced apart from one another in a direction parallel or substantially parallel to the main axis 30 of the slot 28, by a distance between 20 mm and 100 mm, preferably between 40 mm and 70 mm.

As mentioned above, the slot 28 is configured to allow passage of a flange 22 of a heat exchanger as illustrated in FIG. 6 and FIG. 7. It is recalled that the heat exchanger 2 is of parallelepipedic form and comprises, at the level of the collector box 21, a flange 22 extending in a length direction 23. The flange is also of parallelepipedic form and comprises two channels 52 allowing circulation of a coolant fluid inside the heat exchanger. The flange is more particularly arranged close to a vertical end edge of the heat exchanger in order to promote the passage of coolant fluid entering or leaving the heat exchanger.

The flange 22 is configured such that at the level of its free end 54, two opposite edges of the flange are extended by an edging 56, 58. The flange 22 thus has a T-shaped profile which is particularly clear on FIG. 7. For each edging 56, 58, an inner face is defined which is turned towards the collector box from which the flange protrudes, and an outer face turned against the heat exchanger and the collector box.

The shape of the slot 28 forming the passage, and of the rims arranged in the side wall, is provided so as to allow insertion of such a flange with an insertion angle relative to the direction of the axis 30 of the slot 28, then its pivoting into a functional position in which the associated heat exchanger is arranged in a plane containing the axis of the slot, and also to allow adjusted arrangement of the rims provided in the side wall around the flange in order to ensure a sealing function for the encapsulation casing.

More particularly, with reference to FIG. 5, it is understood that the minimal dimension D1 between two crests of the distal ends of the two rims 34, 36 is greater than the dimension D2 between these two crests in a projection plane congruent with the plane of extension of the side wall. The dimension for allowing passage of the flange between the rims is greater when the heat exchanger is presented at an angle relative to its functional position in the frame once assembled, and the rims are dimensioned such that this inclined insertion is obligatory.

This cooperation will now be described with reference to the assembly method during which the heat exchanger is inserted in the support frame 4, with reference to FIG. 8, FIG. 9 and FIG. 10.

The method implements a first step of positioning the heat exchanger in the support frame 4 as illustrated by FIGS. 3 and 8, such that the free end 54 of the flange 22 is arranged opposite the slot 28 in which it is intended to be placed. The heat exchanger is inserted with a positioning similar to that illustrated on FIG. 3, namely an inclined position relative to the final position of the heat exchanger in the support frame. The main plane of extension of the heat exchanger, when inserted during the first step of the method, is inclined relative to the main plane of extension of the heat exchanger when assembled in the support frame 4, by an angular value $\alpha$, as illustrated on FIG. 8, with respect to the axes of the flange and slot. The value of the inclination angle $\alpha$ of the heat exchanger on insertion in the support frame in the first step of the method is between 10° and 80°. In this way, it is understood that the heat exchanger is not displaced in a direction parallel to a plane in which it is situated in the operating position, nor is it inserted perpendicularly to said plane of operating position, i.e. parallel to the direction of circulation of the air flow through the heat exchangers. Preferably, the inclination angle value may lie between 30° and 45°.

According to a second step of the method illustrated in FIG. 9, the heat exchanger is then moved in the direction of the slot 28 so as to insert the free end 54 of the flange 22 in the slot 28 in a translational movement. The flange is introduced into the slot until the edgings 56, 58 of the flange pass the side wall of the support frame and lie in the clearance zone 33.

To achieve this, it is understood that the edgings firstly pass beyond the second rim 36, arranged protruding from the inner face 32 of the side wall 12, and hence are the first to face the flange on insertion of the heat exchanger in the frame. The two edgings of the flange may pass between the second rim 36 and the edge delimiting the passage at the level of the first longitudinal end of the slot, thanks to the inclined insertion of the heat exchanger. Then, at a second time, the edgings pass beyond the first rim 34, where it is understood that the minimal dimension D1 is greater than the longitudinal dimension D of the flange which is defined in particular by the protruding dimension of the two edgings.

In a third step illustrated by FIGS. 9 and 10, the heat exchanger is pivoted such that the axis of extension of the flange becomes parallel or substantially parallel to the main axis 30 of the slot 28. This pivoting takes place in particular about a pivot axis defined by the contact between the flange 22 and the support face 50. It should be noted that the weight of the heat exchanger promotes contact between a side wall 60 of the flange and the support face 50 of the second rim 36, so as to form a constant pivot axis during pivoting. The pivoting continues until the flange 22 seals the slot 28, as shown in FIG. 10. More particularly, the pivoting continues until contact is made between the side wall 61 of the flange, opposite the side wall 60 of the flange serving to define a pivot axis, and the first support face 45 of the first rim 34. Once this pivoting has been performed, the heat exchanger and the associated flange 22 are arranged in a plane containing the axis 30 of the slot 28.

In a final operation, the operator moves the heat exchanger in translation in a direction opposite the side wall 12 in which the slot 28 is made. In this way, contact or near contact is achieved between the inner face of a first edging 56, namely the edging arranged on the side opposite the side wall 60 of the flange serving to define the pivot axis, and the second support face 47 of the first rim 34.

Thus advantageously, the slot 28 is configured such that the rims 34, 36 are in contact and/or close to the walls of the flange, so as to limit the passage of an air flow through the side wall 12 of the support frame 4 and improve the thermal performance of the front end module.

The front end module 1 according to the invention may furthermore comprise a shut-off device comprising a set of shut-off flaps capable of pivoting rotatably so as to vary the flow rate of the air stream, said shut-off device being arranged in the ventilation duct 6 upstream of the heat exchanger relative to the flow of the air stream. The shut-off device further comprises a support frame having bearings so as to hold the shut-off flaps. The axes of rotation allow the shut-off flaps to switch from an open configuration to a closed configuration. The open configuration consists in placing (by rotation) the shut-off flaps so that they provide as little opposition as possible to the passage of the air stream while orienting it appropriately. The closed configuration consists in placing the shut-off flaps so that they provide, by means of their front surface, as much opposition as possible to the flow of the air stream F, in conjunction with the other shut-off flaps.

According to an embodiment of the front end module 1 that is not shown, the heat exchanger and the support frame 4 may be inclined relative to the shut-off device. In other words, the mid-planes of the support frame 4 and of the shut-off device form an angle other than 0° (non-zero), particularly an angle in an interval of 10° to 80°, more specifically in an interval of 30° to 60°. Such an arrangement makes it possible to reduce the spatial footprint of the front end module 1.

It will be understood from reading the above that the present invention proposes a support frame and an associated front end module configured to allow sealed assembly of a heat exchanger in a support frame, without it being necessary to provide sealing elements made of elastomer for example, which, in addition to the cost of an additional part, may present assembly difficulties in the case of a support frame forming part of an encapsulation casing of the heat exchanger.

The invention is not limited to the means and configurations described and illustrated herein, however, and also extends to all equivalent means or configurations and to any technically functional combination of such means. In particular, the shape of the rims may be different and require a diagonal insertion of the heat exchanger, and allow pivoting of this heat exchanger around a pivot axis formed by one of the ribs which also form a chicane for sealing the support frame.

It should be noted that although the invention allows the absence of additional sealing elements, in an embodiment not illustrated, it may be provided that the free ends of the rims formed around the passage in the side wall may be covered by an elastic material so as to ensure that the flange hermetically seals said slot. In another variant, the walls of the flange may be covered by the same type of material to obtain the same desired additional effect.

The invention claimed is:

1. A support frame configured to bear a heat exchanger comprising a flange for passage of coolant fluid, the frame comprising:

a side wall in which a slot is produced for the flange to pass through, wherein the side wall comprises a first rim placed near an end of the slot and disposed at least partially in the slot so as to define an insertion path for the flange which is inclined relative to the normal to the side wall, said first rim also being configured to form a pivot point for the flange, and wherein the first rim comprises:

a first protruding portion that protrudes substantially perpendicularly to the side wall delimiting the slot in a first direction;

a first return portion that extends to reduce a passage cross-section of the slot; and a second return portion that forms a free end of the first rim and extends perpendicular to the first return portion so as to form a staircase profile of the first rim to reduce the passage cross-section of the slot, wherein the support frame comprises a second rim comprising a second protruding portion that protrudes substantially parallel to the side wall delimiting the slot in a second direction perpendicular to the first direction, wherein the second rim comprises:

a first portion; and a return edge that forms a free end of the second rim and extends perpendicular to the first portion of the second rim so as to reduce the passage cross-section of the slot and form a staircase profile of the second rim, wherein the first and second rims delimit opposing ends of the slot, and wherein the first rim and the second rim define the insertion path such that the flange must be inclined relative to the normal to the side wall in order to be inserted in the slot.

2. The support frame as claimed in claim 1, wherein the rims each have a proximal end linked to the side wall and a free distal end, the free distal end of each rim being configured to bear on a surface of the flange when the latter is placed in the support frame.

3. The support frame as claimed in claim 1, wherein the rims each have a bent form extending in a longitudinal projection from the side wall in opposite directions along the normal to said side wall.

4. The support frame as claimed in claim 2, wherein the free distal end of the rim extending in a longitudinal projection from the side wall towards the interior of the frame is configured to serve as a support face for the flange in order to form said pivot point in the slot.

5. The support frame as claimed in claim 2, wherein the rims are configured in a bent portion such that their distal end is closer to the centre of the slot than their proximal end.

6. The support frame as claimed in claim 2, wherein the minimal dimension between two crests of the distal ends of the two rims is greater than the dimension between these two crests in a projection plane congruent with the plane of extension of the side wall.

7. A method for assembly of a heat exchanger with an inlet/outlet flange for coolant fluid in a support frame defined as claimed in claim 1, the method comprising:

insertion of the flange in the slot made in a side wall of the support frame, with an insertion position in a plane which has an angle of inclination between 10° and 80° relative to the plane in which the heat exchanger is positioned at the end of assembly, wherein the insertion brings the flange at an angle through the slot while avoiding the first and second rims; and pivoting the flange in the slot in order to give the heat exchanger its final assembly position which is substantially perpendicular to the side wall.

8. A front end module comprising:

a support frame comprising a side wall in which a slot is produced for a flange to pass through, wherein the side wall comprises a first rim placed near an end of the slot and disposed at least partially in the slot so as to define an insertion path for the flange which is inclined relative to the normal to the side wall, said first rim also being configured to form a pivot point for the flange, wherein the first rim comprises:

a first protruding portion that protrudes substantially perpendicularly to the side wall delimiting the slot in a first direction;

a first return portion that extends to reduce a passage cross-section of the slot; and a second return portion that forms a free end of the first rim and extends perpendicular to the first return portion so as to form a staircase profile of the first rim to reduce the passage cross-section of the slot, wherein the support frame comprises a second rim comprising a second protruding portion that protrudes substantially parallel to the side wall delimiting the slot in a second direction perpendicular to the first direction, wherein the second rim comprises:

a first portion; and a return edge that forms a free end of the second rim and extends perpendicular to the first portion of the second rim so as to reduce the passage cross-section of the slot and form a staircase profile of the second rim, wherein the first and second rims delimit opposing ends of the slot, wherein at least one heat exchanger bearing a flange for inlet or outlet of coolant fluid, said flange bearing against at least one support face formed by the first and second rims of said support frame, and wherein the first rim and the second rim define the insertion path such that the flange must be inclined relative to the normal to the side wall in order to be inserted in the slot.

9. The front end module as claimed in claim 8, wherein at its free end, the flange comprises at least one edging configured to come to rest against the first rim of the support frame.

* * * * *